US006568880B2

(12) United States Patent
De Medeiros Junio et al.

(10) Patent No.: US 6,568,880 B2
(45) **Date of Patent: *May 27, 2003**

(54) FOUNDATION SYSTEM FOR TENSION LEG PLATFORMS

(75) Inventors: Cipriano José De Medeiros Junio, Rio (BR); Elisabeth De Campos Porto, Rio (BR); Maria Marta De Castro Rosas, Rio (BR); Isaías Quaresma Masetti, Rio (BR)

(73) Assignee: Petroleo Brasileiro S.A. - Petrobras (BR)

( * ) Notice: Subject to any disclaimer, the term of this patent is extended or adjusted under 35 U.S.C. 154(b) by 0 days.

This patent is subject to a terminal disclaimer.

(21) Appl. No.: 09/988,607

(22) Filed: Nov. 20, 2001

(65) Prior Publication Data

US 2002/0031404 A1 Mar. 14, 2002

Related U.S. Application Data

(63) Continuation of application No. 08/733,698, filed on Oct. 17, 1996, now Pat. No. 6,318,933, which is a continuation of application No. 08/298,753, filed on Aug. 31, 1994, now abandoned.

(30) Foreign Application Priority Data

Aug. 31, 1993 (BR) ..... 9303646

(51) Int. Cl.[7] ..... B63B 35/44; E02D 5/74

(52) U.S. Cl. ..... 405/224; 405/223.1; 405/227; 114/265

(58) Field of Search ..... 405/223.1, 227, 405/224, 224.1–224.4; 114/264, 265

(56) References Cited

U.S. PATENT DOCUMENTS 2,960,832 A 11/1960 Hayward ..... 405/227

(List continued on next page.)

FOREIGN PATENT DOCUMENTS

AU 623085 3/1989

(List continued on next page.)

OTHER PUBLICATIONS

Sprague, Completion of Hutton Field Pre–Drilled wells from a Semi–Submersible, Advances in Underwater Technology and Offshore Engineering: vol.2: Design and Installation of Subsea Systems pp.77–105. 1985 (abstract only).

(List continued on next page.)

*Primary Examiner*—Robert E. Pezzuto
*Assistant Examiner*—Tara L. Mayo
(74) *Attorney, Agent, or Firm*—Nixon & Vanderhye PC

(57) ABSTRACT

A foundation system for tension leg platforms without use of foundation templates, wherein each tendon (5) is directly connected to a socket (9) inside a pile (8), the piles (8) being positioned for driving purpose by a pile-driving template (10) which is employed as a spacing device. The pile-driving template (10) is positioned with the aid of pins (11) that slot into guides (7) built into the well template (6). After the groups of piles (8) needed to anchor a corner of the platform (1) have been driven in, the pile-driving template (10) is withdrawn and repositioned so as to enable the piles for the other group of legs to be driven; this process continues until all of the pile-driving is finished. Alternatively one single pile-driving template (16) may be employed to guide the driving of all the piles (8) thus doing away with the need to reposition the template every time. The bottom ends (14) of the piles are conical in shape, and after the piles have been driven they are filled up with some high specific gravity material.

24 Claims, 6 Drawing Sheets

U.S. PATENT DOCUMENTS

| | | | | |
|---|---|---|---|---|
| 2,987,842 | A | 6/1961 | Reeve | 405/227 X |
| 3,496,900 | A | 2/1970 | Mott et al. | 405/224 X |
| 3,646,770 | A | 3/1972 | Van Daalen | 405/227 |
| 3,955,521 | A | 5/1976 | Mott | 405/224 X |
| 4,126,008 | A | 11/1978 | Dixon | 405/227 X |
| 4,226,555 | A | 10/1980 | Bourne, Jr. et al. | 405/224 |
| 4,248,549 | A | 2/1981 | Czerewaty | 405/224 |
| 4,285,615 | A | 8/1981 | Radd | 405/223.1 X |
| 4,344,721 | A | 8/1982 | Goldsmith | 405/224 |
| 4,351,258 | A | 9/1982 | Ray | |
| 4,352,599 | A | 10/1982 | Goldsmith | 405/224 |
| 4,374,630 | A | 2/1983 | Fraser, Jr. | 405/224 |
| 4,386,874 | A | 6/1983 | Engelsen et al. | 405/223.1 X |
| 4,391,554 | A | 7/1983 | Jones | 405/224 |
| 4,432,670 | A | 2/1984 | Lawson | 405/223.1 X |
| 4,459,933 | A | 7/1984 | Burchett | 405/224 X |
| 4,516,882 | A | 5/1985 | Brewer et al. | 405/224 |
| 4,540,314 | A | 9/1985 | Falkner, Jr. | 405/224 X |
| 4,597,350 | A | 7/1986 | Mott | 405/224 X |
| 4,611,953 | A | 9/1986 | Owens | 405/224 |
| 4,614,461 | A | 9/1986 | Taniguchi et al. | 204/196.19 |
| 4,620,820 | A | 11/1986 | Collipp | 405/224 |
| 4,637,757 | A | 1/1987 | Aagaard | 405/227 |
| 4,687,062 | A | 8/1987 | Beghetto et al. | 405/227 X |
| 4,768,455 | A | 9/1988 | Maxson et al. | 114/264 |
| 4,780,026 | A | 10/1988 | Gunderson | 405/224 |
| 4,784,224 | A | 11/1988 | Leach et al. | 166/339 |
| 4,784,527 | A | 11/1988 | Hunter et al. | 405/207 |
| 4,784,529 | A | 11/1988 | Hunter | |
| 4,818,147 | A | 4/1989 | Rasmussen | |
| 4,844,659 | A | 7/1989 | Hunter et al. | 405/224 |
| 4,848,970 | A | 7/1989 | Hunter et al. | |
| 4,875,806 | A | 10/1989 | Lindberg et al. | 405/224 |
| 4,881,852 | A | 11/1989 | Gunderson | 405/224 |
| 4,895,481 | A | 1/1990 | Pepin-Lehalleur et al. | 405/223.1 X |
| 4,907,914 | A | 3/1990 | Gunderson et al. | |
| 4,943,188 | A | 7/1990 | Peppel | 405/223.1 |
| 4,990,030 | A | 2/1991 | Salama et al. | 405/224 |
| 5,114,276 | A | 5/1992 | Dupin | 405/223.1 X |
| 5,118,221 | A | 6/1992 | Copple | |
| 5,174,687 | A | 12/1992 | Dunlop et al. | 405/223.1 |
| 5,197,825 | A | 3/1993 | Rasmussen | |
| 6,036,404 | A | 3/2000 | De Medeiros, Jr. et al. | 405/223.1 |
| 6,142,709 | A | 11/2000 | De Medeiros Jr. et al. | 405/224 |
| 6,312,195 | B1 | 11/2001 | De Medeiros Jr. et al. | 405/224 |
| 6,318,933 | B1 | 11/2001 | De Medeiros, Jr. et al. | 405/223.1 |

FOREIGN PATENT DOCUMENTS

| | | |
|---|---|---|
| CA | 1194856 | 10/1985 |
| EP | 177197 | 4/1986 |
| EP | 0302546 | 2/1989 |
| EP | 0 441 413 | 8/1991 |
| GB | 2 034 378 | 6/1980 |
| GB | 2 035 240 | 6/1980 |
| GB | 2178101 | 2/1987 |
| GB | 2 178 101 | 2/1987 |
| GB | 2 198 171 | 6/1988 |
| WO | WO 95/29780 | 11/1995 |
| WO | WO 95/29839 | 11/1995 |

OTHER PUBLICATIONS

Gunton, The Nort Sea—Home of Technological Achievement, Oil Gas Australia, pp36, 39 Nov. 1985 (abstract only).

Tebbett et al., Design and Installation of Piled Foundations for Seabed Structures, Subsea '85 Int. Conf. (London, 12/3–4/85), 24 pp. 1985 (abstract only).

Chaplin, Template Installations for Floating/Tethered Systems, Ocean Ind., v. 21, No. 5, pp 56–57, May 1986 (abstract only).

Dutta et al., Tubular Tendon for a Tension Leg Platform: Material Development and Threaded Connection Design, 17th Annu. Spe of AIME et al. Offshore Technol. Conf. (Houston, 5/6–9/85) Proc., v. 4, pp 511–521. 1985 (abstract only).

World's First TLP [Tension Leg PAL\\Latform] Producing Hutton Field Oil—Petrol. Eng. Int., v. 56, No. 12, pp10, 14, Oct. 1984 (abstract only).

Takeshi et al., Reasearch and Development of a Three–Piece Tendon for a TLP [Tend\Sion Leg Platform], 17th Annu. SPE of AIME et al., Offshore Technol. Conf. (Houston, 5/6–9/85) Proc., v. 4, pp 499–510, 1985 (abstract only).

Sparks et al., P1 TR 1000—A Concrete Tension Leg Platform; 4th ASME et al. Int. Offshore Mech. & Arctic Eng. Symp. (Dallas, 2/17–21/85) Proc., v. 1, pp 14–21, 1985 (abstract only).

Taylor, Conococ's Tension Leg Platform Will Double Water Depth Capability, Ocean Ind., v. 15, No. 2, pp 35–39, Feb. 1980 (abstract only).

Monitoring Moorings of North Sea Platforms, Contr. Instrum., V. 15, No. 1 p. 43, Jan. 1983 (abstract only).

Franco, Jolliet's TLWP [Tension Leg Well Platform] Brings Innovation to the Gulf, Drilling Contract, v. 45, No.4, pp. 9–11, Jun.–Jul. 1989 (abstract only).

Hagar, Conoco Slates Pioneering TLWP [Tension Leg Well Platform] Off Louisiana, Oil Bas J., v. 85, No. 9, pp. 18–19, Mar. 2, 1987 (abstract only).

Sparks, PLTB 1000: A Concrete Tension Line Platform for 1000 Meters Water Depth; Petrol Tech., No. 322, pp. 35–37, Jan.–Feb. 1986 (abstract only).

Tassini et al., Floating Production System for Mediterranean Deep Water Areas, 3rd Deep Offshore Technol. [DOT] Conf.(sorrento, Italy, 10/21–23/85) PROC. V. 2, pap. No.IIL11, 1985 (abstract only).

Sebastiani et al., Theoretical–Experimental Behavior of TLP [Tension Leg Platform] for Very Deep Waters, 2nd Int. ASME Offshore Mech. & Arctic Eng. Symp. (Houston, Jan. 30, 1983–Feb. 3, 1983) Proc., PP. 1–14, 1983 (abstract only).

John Abbott, Auger Tension Leg Platform, pp. 20–30 (undated).

John Abbott, Mars Tension Leg Platform, pp. 14–24 (undated).

Offshore Rig Report, Ocean Oil Weekly Report, Apr. 1, 1966, p. 8.

Danny Keener, "Positioning the Mars TLP tendons and free–standing piles", Offshore, Jul. 1996, pp. 64 & 66.

"Mars on the move", Offshore Engineer, Apr. 1994, pp. 41.

John Abbott, RAM/Powell Tension Leg Platform, pp. 8–13 (undated).

FOUNDATION SYSTEM FOR TENSION LEG PLATFORMS

This application is a continuation of application Ser. No. 08/733,698, filed Oct. 17, 1996, now U.S. Pat. No. 6,318,933, which was a continuation of application Ser. No. 08/298,753, filed Aug. 31, 1994, now abandoned, the entire content of which is hereby incorporated by reference in this application.

FIELD OF INVENTION

This invention relates to a foundation system for tension leg platforms where tendons are anchored directly to sockets fitted inside the piles thereby doing away with the need to make use of rigid structures known as foundation templates.

STATE OF THE ART

Various kinds of anchoring pile systems for tension leg platforms—TLPs—are known. In all of them transfer of the anchored load to the piles is achieved by means of a structure in the sea bottom, known as a foundation template. This template has cylindrically shaped guides into which are driven tubular piles which are fixed to the foundation template either by cementing the annular space between the cylindrically shaped guide and the pile, or by deforming the steel of the pile with the aid of a tool which expands it against the guide, thereby bringing about a mechanical connection between the pile and the guide.

U.S. Pat. No. 4,620,820 illustrates a foundation system such as the one described above and discloses equipment and an anchoring system for a tension leg platform anchored to the sea bottom by means of an anchoring assembly made up of upper and lower parts. The upper part thereof is tied to the bottom ends of the tendons forming the tension legs of the tension leg platform. The upper part of the anchoring assembly serves to space out and line up each tendon, keeping them straight when the upper part of the assembly is joined to the lower part which has first of all been fixed to the sea bottom by means of the piles.

The foundation templates have to withstand cycles of heavy strain and must therefore be designed to withstand the ensuing fatigue which inevitably leads to their being sturdily and heavily built, thereby increasing the anchoring cost. Another critical point is that the joining of piles to the templates is prone to failure.

The invention described and claimed herein introduces significant modifications in such a system, does away with the need for templates in the foundations, cuts down on the cost of anchoring and considerably reduces the likelihood of failure since there are fewer mechanical parts.

SUMMARY OF THE INVENTION

For the purpose of principally doing away with the need for foundation templates, thus diminishing the cost of materials and the installation costs, this invention provides a tension leg platform foundation system wherein each tendon is directly connected to its pile by means of a socket fitted into the pile, the piles being driven in with the aid of a template which also serves to keep the piles apart from the template for the wells as they are positioned by means of pins that slot into guides fitted into the well-drilling template. After piles have been driven to anchor down one corner of the platform the template is withdrawn, and repositioned, so as to enable the piles for the other tendons to be driven, this procedure is repeated until all the piles have been driven.

The pile-driving template can also be built so as to serve as a guide for all of the piles thereby doing away with the need to reposition the template after each group of piles has been driven.

BRIEF DESCRIPTION OF THE DRAWINGS

These and other purposes of this invention will be more easily perceived from the following detailed description given with reference to the accompanying drawings, in which.

DETAILED DESCRIPTION OF THE INVENTION

Figure 1:
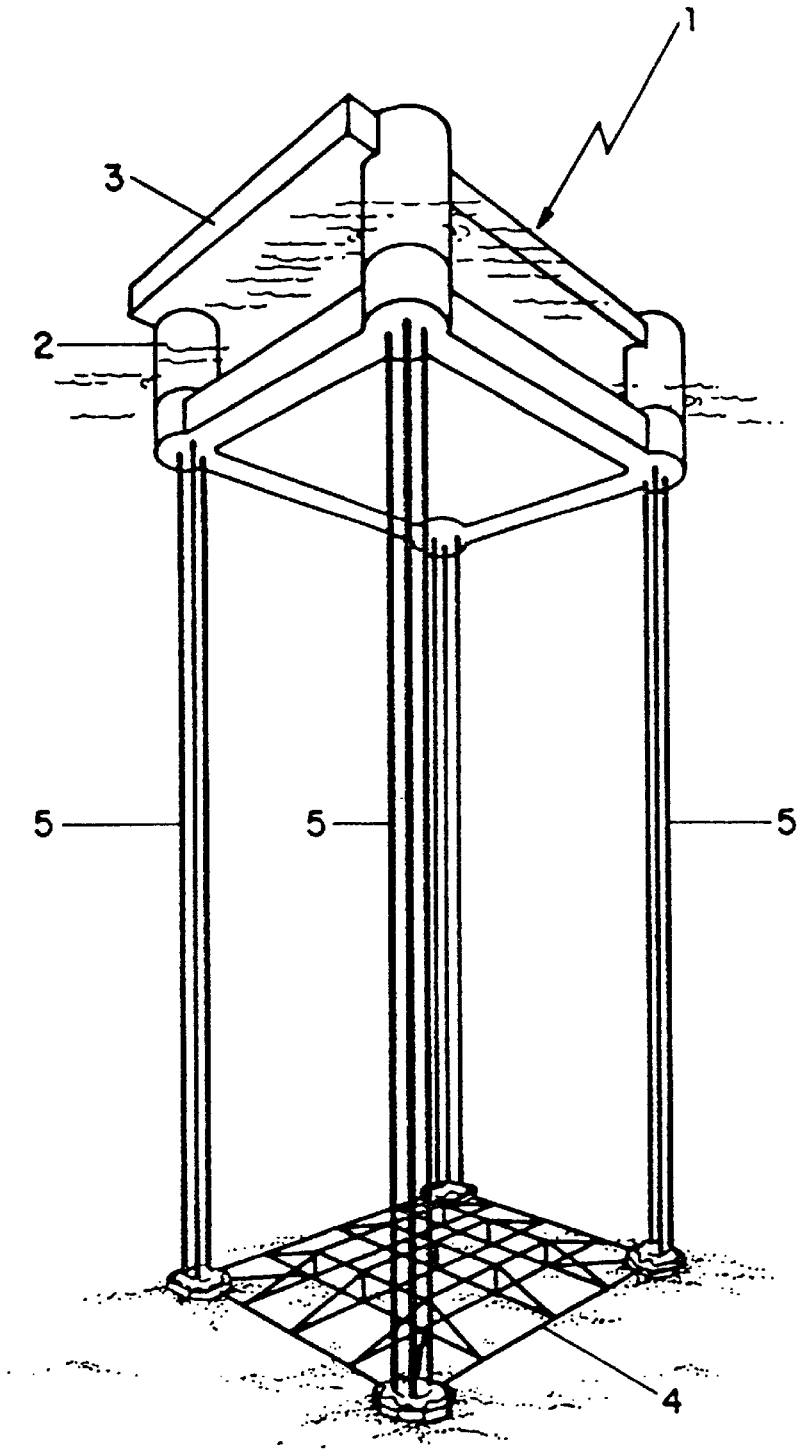
FIG. 1 (Prior Art)
FIG. 1 is a partial view, in perspective, of an offshore platform anchored by tension legs attached to a foundation template fixed to the sea bottom.

Conventional tension leg platforms have their tendons anchored to a foundation structure fixed to the bottom of the sea by means of piles or by gravity alone. FIG. 1 is a perspective view of an offshore platform (1) held up by columns (2) arranged about the corners of a supporting structure (3), which is anchored to a foundation structure (4) by means of tendons (5). The foundation structure (4), referred to by those skilled in the art as a template, is fixed to the sea bottom by means of tubular piles (not shown in the drawing).

It should be pointed out that, in order to make it easier to understand the attached drawings, this description merely covers parts directly connected therewith; any other parts needed to complete the picture, and widely known by the experts, have been left out along with certain details thereof.

For the purpose of dispensing with the need for foundation templates which, because they have to stand up to cycles of heavy strain, must therefore be designed to withstand the ensuing fatigue which inevitably leads to their being sturdily and heavily built, and costly, this invention provides a foundation system for tension leg platforms as shown in FIGS. 2 to 5.

Figure 2:
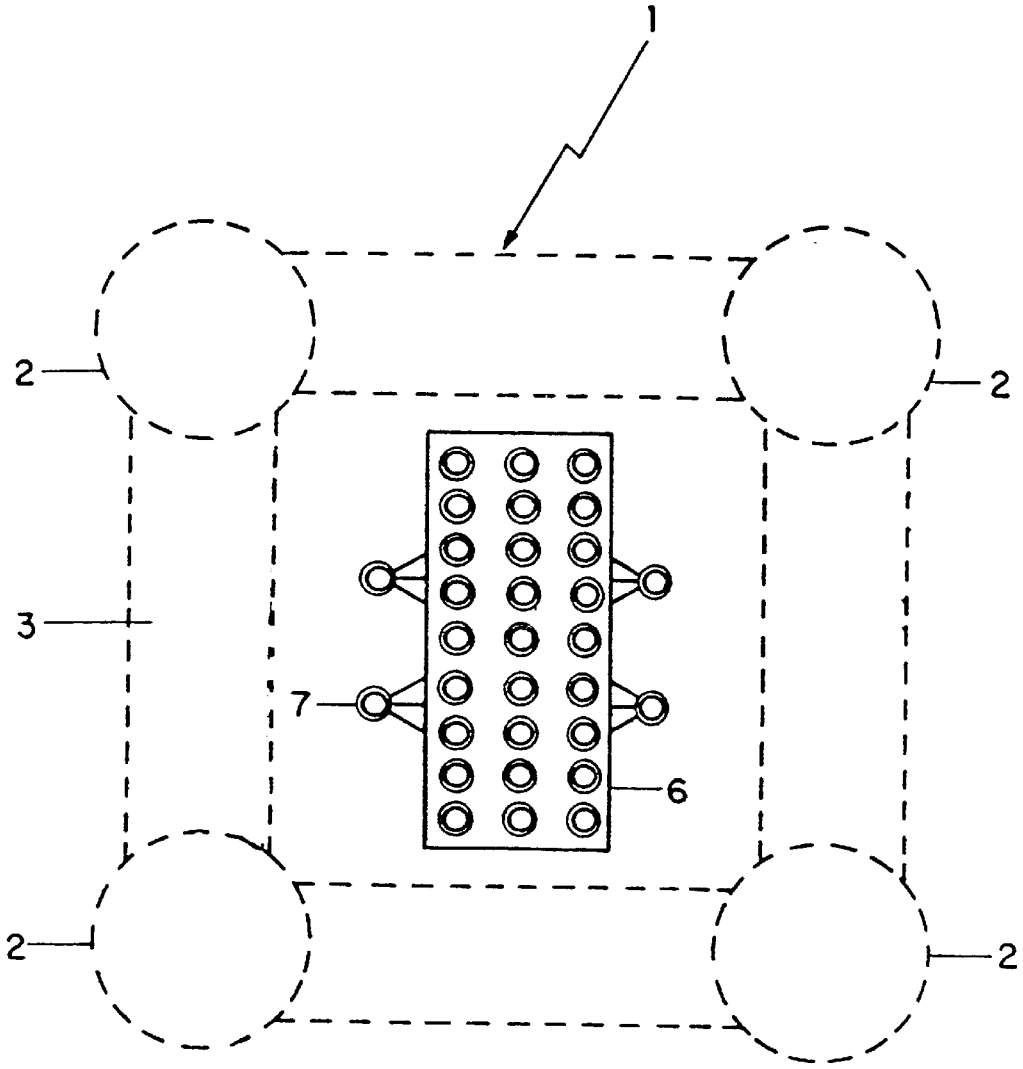
FIG. 2 is a schematic top plan view of a platform positioned over the well template.
Figure 3:
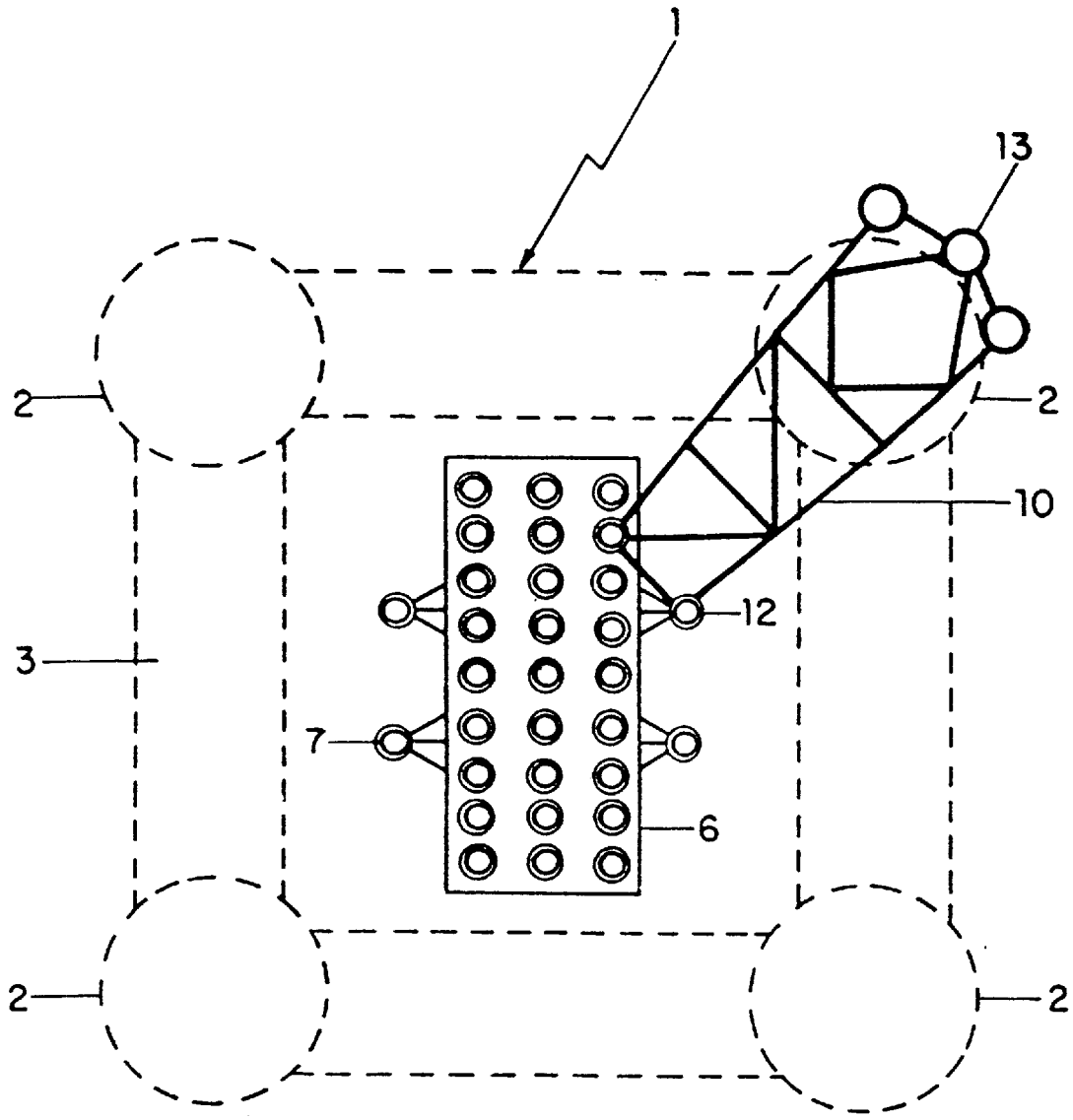
FIG. 3 is a schematic top plan view of a platform positioned over a well template and a pile-driving template.

FIGS. 2 and 3 are schematic top plan views of a supporting structure (3) for a tension leg platform positioned over a well template (6) fixed to the sea bottom, the well template (6) having guides (7) that serve to position the template (10) as will be described later.

Figure 4:
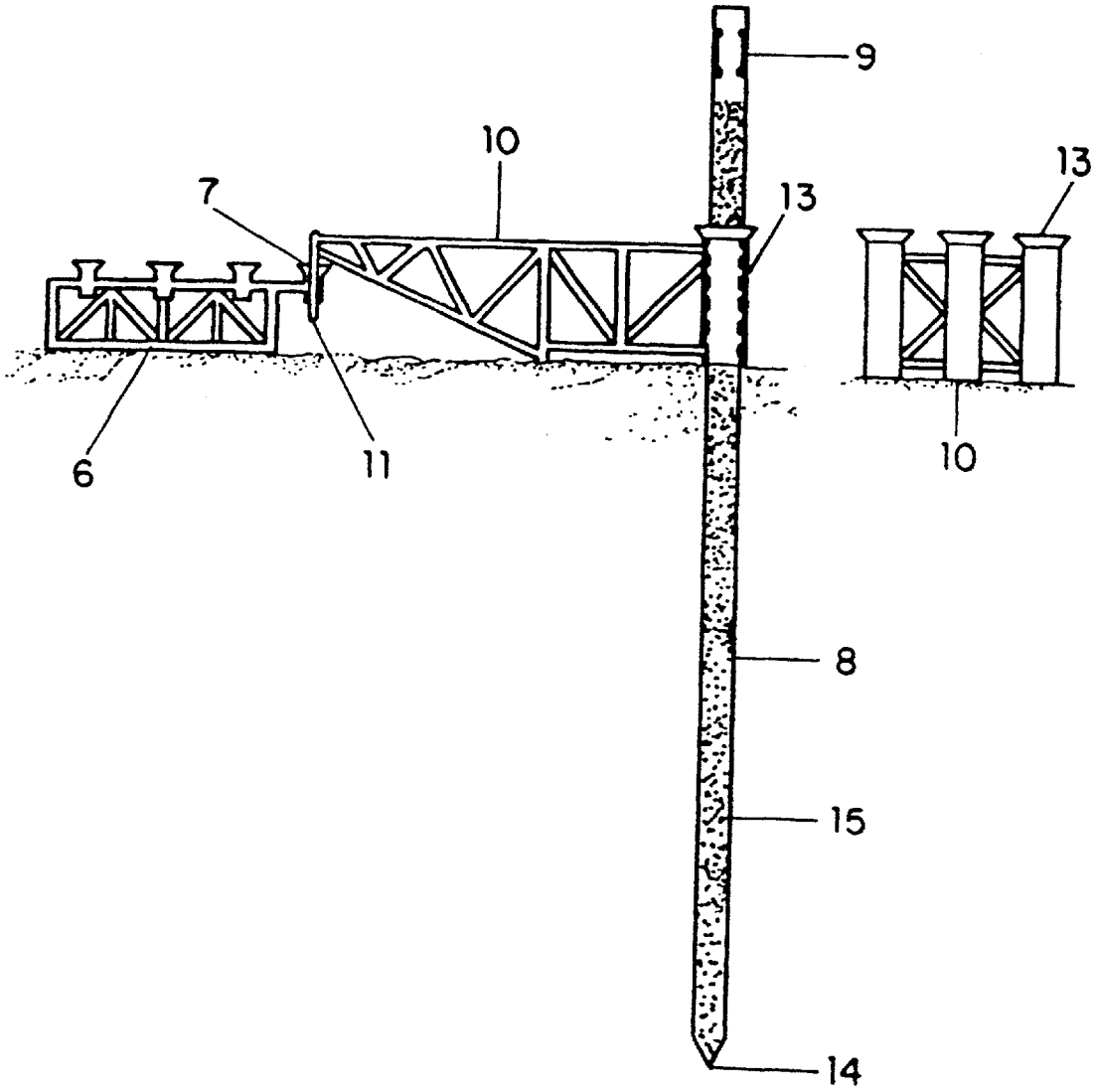
FIG. 4 is a schematic side view of the foundation system of the invention for a tension leg platform, and includes a schematic front view of the pile-driving template.

FIG. 4 shows piles (8) driven in with the aid of a pile-driving template (10), which is a tubular structure, and which also serves to keep the groups of piles apart from the production template. The pile-driving template (10) is positioned with the aid of pins (11) which slot into guides (7) fitted on the well template (6).

The pile-driving template (10) is a tubular structure whose top part is fitted with pins (11) that slot into the guides (7) of the well template (6) so as to ensure proper positioning of piles (8) before they are driven into the sea bed through guides (13) fitted into the front of the pile-driving template (10).

Figure 5:
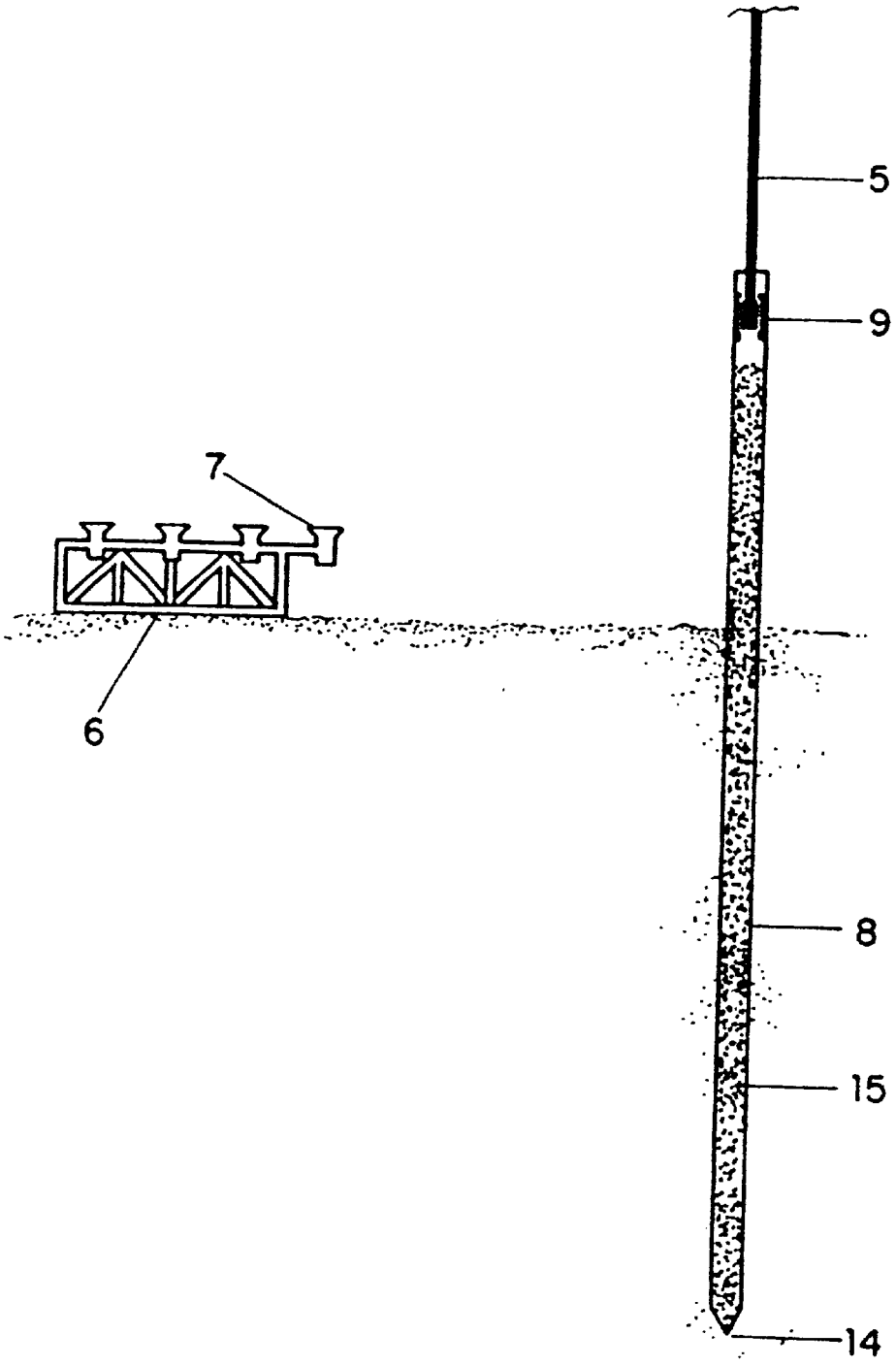
FIG. 5 is a schematic view showing how a tendon fits into a pile.

FIG. 5 shows a tendon (5) fitted directly into socket (9) built into the pile (8), thus eliminating any need for a foundation template such as is shown at (4) in FIG. 1. Those skilled in the art will understand that more than one pile may be used to fix a tendon and also that more than one tendon may be fixed to a pile.

Figure 6:
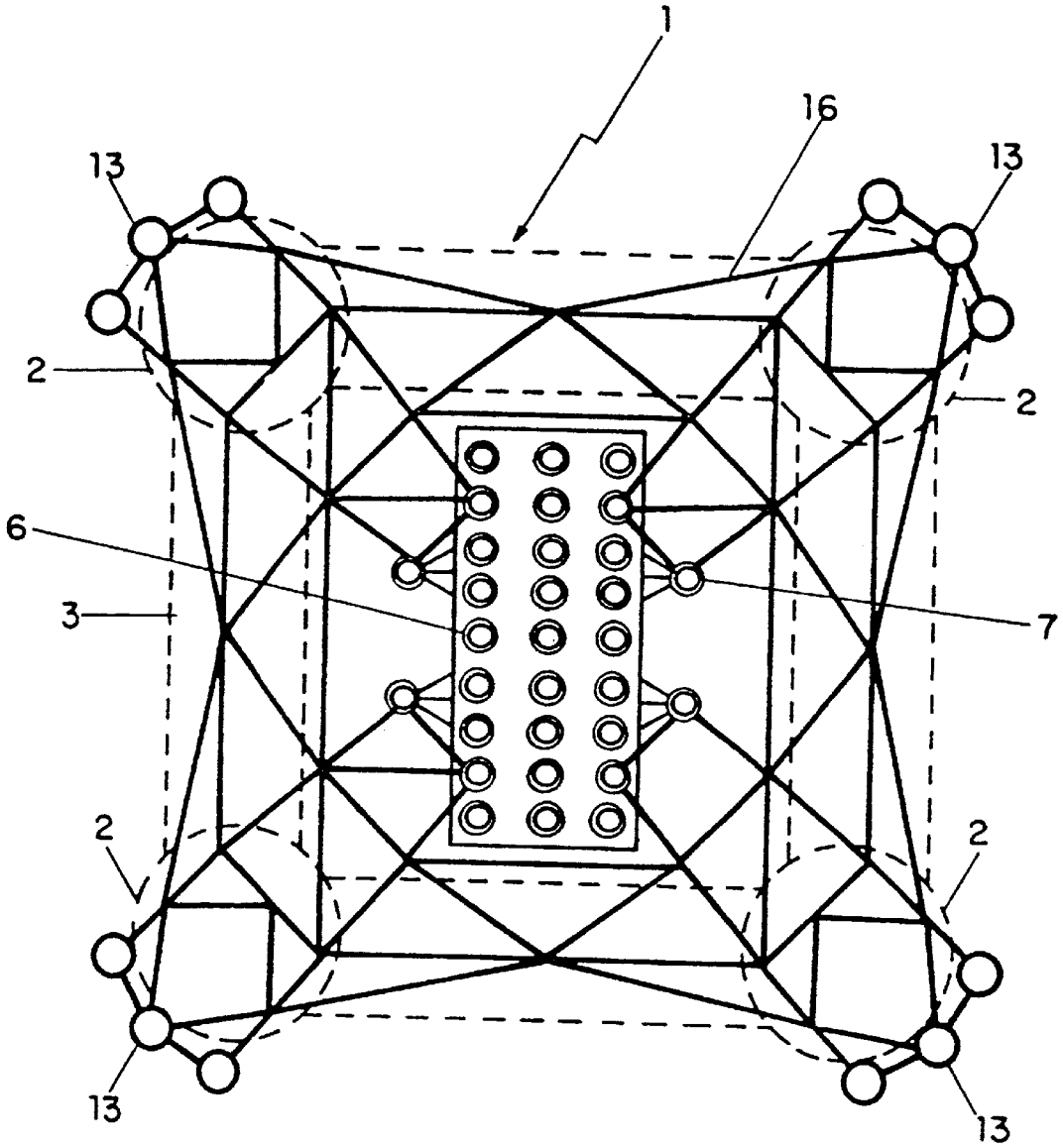
FIG. 6 is a schematic top plan view of a platform positioned over the well template and the pile-driving template, which latter serves as a guide for all of the piles.

After piles (8) have been driven to anchor a corner of the platform (1), the pile-driving template (10) is withdrawn and repositioned so as to enable the piles for the remaining tendons to be driven. This procedure is continued until all of the piles have been put in. The template (10) may also be built so that one template (10) can serve as a guide for the driving of all of the piles (8) as a whole without repositioning. Such an alternative is shown in FIG. 6, where a single template (16) eliminates the need to reposition after every group of piles has been driven. Either of these two kinds of templates may or may not be raised from the sea bottom after all of the piles have been driven.

For greater anchoring reliability use it is suggested that piles (8) be used which have closed conically shaped ends (14) as disclosed in our AU-B 623085.

After the pile (8) has been driven, its conical end (14) must be filled up with high specific gravity ballast (15). Thus, anchoring strains suffered by the platform are borne by the very weight of the pile/ballast assembly. Only when ambient conditions become extremely bad, to the extent that part of the pull away load becomes greater than such weight, will the ground into which the foundations have been laid suffer any strain. Use of such a pile/ballast method diminishes the effects of cyclic loads in the breaking down of clayish formations, since the ground will be subjected to such forces only in stormy weather which lasts only for a short while and does not happen very often.

In addition to increasing the anchoring capacity, the ballast (15) for the piles (8) allows for shallower driving and for shorter piles, which means easier and cheaper handling. Ballast, which is not employed in conventional kinds of foundations, consists of low cost material, preferably hematite.

Adoption of the above described system in the design of tension leg platforms will lead to a considerable reduction in not only the cost of materials but also the installation costs, since there is no need for a foundation template (4) to drive the piles; such a template accounts for a considerable portion of the overall cost of anchoring.

Another point to be considered is the high cost of having to work upon the foundation template in the event of damage to platform tendons, which will not apply in the case of the system proposed herein because the tendon anchoring systems are independent of one another. If damage does occur it will only be to the the socket (9) of the pile.

What is claimed is:

1. A tension leg platform foundation system in combination with a tension leg platform secured to a floor of an ocean, said tension leg platform having a buoyant hull adapted to float in said ocean, said foundation system comprising:

a plurality of tension legs depending vertically downwardly from said buoyant hull, each said tension leg being formed from at least one tendon structure;

a plurality of piles secured to the ocean floor, each said pile having a distal end driven into the ocean floor and a proximal end exposed to said ocean adjacent said ocean floor, each said pile being unsecured to any other structure that is on the ocean floor, each said pile having a tendon receptacle at said proximal end thereof, each said pile being disposed in a predetermined position substantially directly vertically below a connection of a respective tension leg to said platform, each said tendon structure of each said tension leg being connected directly to said tendon receptacle of a said pile disposed substantially directly vertically therebelow to define a tendon structure to pile anchoring system, whereby load from each said tendon structure is transferred to the ocean floor through substantially axially aligned load paths of tendon structure to tendon receptacle to pile to ocean floor, and wherein each tendon structure to pile anchoring system is substantially independent of one another, said tendon structure to pile anchoring systems defining a foundation anchor system adapted to withstand exposure to environmental forces including repeated cycles of strain due to forces of nature by transferring anchored load to said piles in the absence of a foundation template, whereby the buoyant hull can remain continuously engaged with the foundation anchor system during said exposure to environmental forces.

2. A foundation system as set forth in claim 1, wherein each said pile is hollow and has a closed conical bottom end.

3. A foundation system as set forth in claim 2, wherein each said pile is filled with a ballast.

4. A foundation system as set forth in claim 1, further comprising a well template and at least one pile guide template detachably connected to said well template and separable from said piles.

5. The foundation system as set forth in claim 1 wherein a plurality of tendon structures are fastened to at least one of said piles.

6. The foundation system as set forth in claim 5 wherein at least one of said piles is hollow and has said tendon receptacle defined as a socket in said proximal end thereof and has a closed conical point at the distal end thereof.

7. A foundation system as set forth in claim 6 wherein said at least one hollow pile is filled with a ballast.

8. A foundation system as set forth in claim 1 wherein at least one of said tendon structures is connected to more than one of said piles.

9. A foundation system as set forth in claim 8 wherein said piles are hollow and have tendon receptacles defined as sockets in proximal ends thereof and have closed conical points at distal ends thereof.

10. A foundation system as set forth in claim 9 wherein said piles are filled with a ballast consisting of high specific gravity material.

11. A tension leg platform foundation system in combination with a tension leg platform secured to a floor of an ocean, said tension leg platform having a buoyant hull adapted to float in said ocean, said foundation system comprising:

a plurality of tension legs depending vertically downwardly from said buoyant hull, each said tension leg being formed from at least one tendon structure;

a plurality of piles secured to the ocean floor, each said pile having a distal end driven into the ocean floor and a proximal end exposed to said ocean adjacent said ocean floor, each said pile being unsecured to any other structure that is on the ocean floor, each said pile having a tendon receptacle at said proximal end thereof, each said pile being disposed substantially directly vertically below a connection of a respective tension leg to said platform, each said tendon structure of each said tension leg being connected directly to said tendon receptacle of a said pile disposed substantially directly vertically therebelow to define a tendon structure to pile anchoring system, whereby load from each said tendon structure is transferred to the ocean floor through substantially axially aligned load paths of tendon structure to tendon receptacle to pile to ocean floor, and wherein each tendon structure to pile anchoring system is substantially independent of one another, further comprising a well template and at least one pile guide template detachably connected to said well template and separable from said piles.

12. A tension leg platform foundation system in combination with a tension leg platform secured to a floor of an ocean, said tension leg platform having a buoyant hull adapted to float in said ocean, said foundation system comprising:

a plurality of tension legs depending vertically downwardly from said buoyant hull, each said tension leg being formed from at least one tendon structure;

a plurality of piles secured to the ocean floor, each said pile having a distal end driven into the ocean floor and a proximal end exposed to said ocean adjacent said ocean floor, each said pile being unsecured to any other structure that is on the ocean floor, each said pile having a tendon receptacle at said proximal end thereof, each said pile being disposed substantially directly vertically below a connection of a respective tension leg to said platform, each said tendon structure of each said tension leg being connected directly to said tendon receptacle of a said pile disposed substantially directly vertically therebelow to define a tendon structure to pile anchoring system, whereby load from each said tendon structure is transferred to the ocean floor through substantially axially aligned load paths of tendon structure to tendon receptacle to pile to ocean floor, and wherein each tendon structure to pile anchoring system is substantially independent of one another; and at least one temporary template disposed on the ocean floor for facilitating determining a location for said piles, said at least one temporary template being free from mechanical interconnection to any of said piles.

13. A foundation system as set forth in claim 12, wherein each said pile is hollow and has a closed conical bottom end.

14. A foundation system as set forth in claim 13, wherein each said pile is filled with a ballast.

15. The foundation system as set forth in claim 12, wherein a plurality of tendon structures are fastened to at least one of said piles.

16. A foundation system as set forth in claim 12, wherein at least one of said tendon structures is connected to more than one of said piles.

17. A method of installing a foundation for a tension leg platform and securing the tension leg platform thereto so that the tension leg platform is substantially permanently secured to a floor of an ocean, comprising:

installing a plurality of piles so that each said pile has a distal end driven into the ocean floor and a proximal end exposed to said ocean adjacent said ocean floor, and so that each said pile is secured to the ocean floor and unsecured to any other structure that is on the ocean floor;

providing a tension leg platform having a buoyant hull adapted to float in said ocean and having a plurality of tension legs depending vertically downwardly from said buoyant hull, each said tension leg being formed from at least one tendon structure, each said tendon structure extending downwardly from said tension leg platform at least substantially to the ocean floor, wherein each said pile is installed so that said pile is disposed substantially directly vertically below a connection of a respective tension leg to said platform; and securing each said tendon structure of each said tension leg directly to a tendon receptacle formed in said proximal end of a said pile disposed substantially vertically therebelow to define a tension structure to pile anchoring system, such that anchoring load paths from the tension leg platform to the ocean floor are established in a plurality of generally vertical paths extending in axial alignment through said tendon structures to tendon receptacle to said pile to ocean floor and load is transferred to said piles in the absence of a foundation template and wherein each tendon structure to pile anchoring system is substantially independent of one another.

18. The method of claim 17, wherein said step of driving a plurality of piles comprises providing at least one temporary template on the ocean floor, at least one said template being a pile-driving template having at least one pile guide structure, and placing piles in predetermined positions relative to one another by installing said piles through respective pile guide structures.

19. The method of claim 18, further comprising removing said pile-driving template after said piles are installed therethrough and before said tendon structures are secured to said piles.

20. The method claim 18, wherein said step of installing further comprises the steps of providing a well template on the ocean floor, and selectively engaging said pile-driving template with said well template so as to define a location for driving said piles relative to said well template.

21. The method of claim 20, wherein said step of engaging comprises positioning a pin provided on said pile-driving template into a corresponding pin receiver provided on the well template thereby to properly position the pile-driving template relative to said well template before said step of driving said piles into the ocean floor.

22. The method of claim 20, wherein each said pile driving template is selectively detachable and attachable to said well template in any one of a plurality of locations about a periphery of said well template so as to selectively define a location for driving said piles relative to said well template.

23. The method of claim 18, wherein said tendon receptacle is a socket defined in said pile, and said step of securing comprises directly coupling said tendon structure to said socket.

24. The method of claim 18, further comprising, after driving each said pile, filling each said pile with a ballast material.

* * * * *